US005395044A

United States Patent [19]

Stout

[11] Patent Number: 5,395,044

[45] Date of Patent: Mar. 7, 1995

[54] INTEGRAL HANDLE FOR CARTON FOR BEVERAGE CAN PACKAGE

[75] Inventor: James T. Stout, Ellijay, Ga.

[73] Assignee: The Mead Corporation, Dayton, Ohio

[21] Appl. No.: 225,675

[22] Filed: Apr. 11, 1994

[51] Int. Cl.[6] ..... B65D 5/46

[52] U.S. Cl. ..... 229/117.13; 229/117.16

[58] Field of Search ..... 229/117.13, 117.16; 206/141, 427

[56] References Cited

U.S. PATENT DOCUMENTS

| | | | |
|---|---|---|---|
| 2,684,759 | 7/1954 | Freeman | 229/117.13 |
| 2,785,847 | 3/1957 | Forrer | 229/117.13 |
| 3,993,303 | 1/1976 | Kirby, Jr. | 229/117.13 |
| 3,994,432 | 11/1976 | Kirby, Jr. | 229/117.13 |
| 4,155,449 | 5/1979 | Bryne | 206/427 |
| 4,478,334 | 10/1984 | Graser | 206/427 |
| 4,508,258 | 4/1985 | Graser | 229/40 |
| 4,588,084 | 5/1986 | Holley, Jr. | 206/427 |
| 4,784,316 | 11/1988 | Crouch | 229/117.13 |
| 4,919,266 | 4/1990 | McIntosh, Jr. et al. | 206/427 |
| 4,966,324 | 10/1990 | Steel | 229/117.13 |
| 5,197,598 | 3/1993 | Stout et al. | 206/141 |
| 5,222,658 | 6/1993 | DeMaio et al. | 229/117.13 |
| 5,234,102 | 8/1993 | Schuster et al. | 206/141 |
| 5,246,112 | 9/1993 | Stout et al. | 206/427 |

FOREIGN PATENT DOCUMENTS

| | | |
|---|---|---|
| 2526398 | 11/1983 | France . |
| 3317039 | 11/1983 | Germany . |

*Primary Examiner*—Gary E. Elkins
*Attorney, Agent, or Firm*—Michael V. Drew

[57] ABSTRACT

A handle (30) is integrally formed with a carton (20) by apertures (20) adjacent the handle (30). Each aperture (20) is covered by a combination of tabs (22, 24) which are foldable out of the plane of the aperture (20) to define the sides of the handle (30). In a tripartite arrangement of tabs (22, 24) a center tab (22) lies between opposing end tabs (24). The center tab (22) and end tabs (24) are foldably joined to opposite sides of the aperture (20). The center tab (22) is contoured and etched with fold lines (38, 42) which encourage bending of the center tab (22) about cans (1) or similarly shaped articles encased by the carton (10).

20 Claims, 4 Drawing Sheets

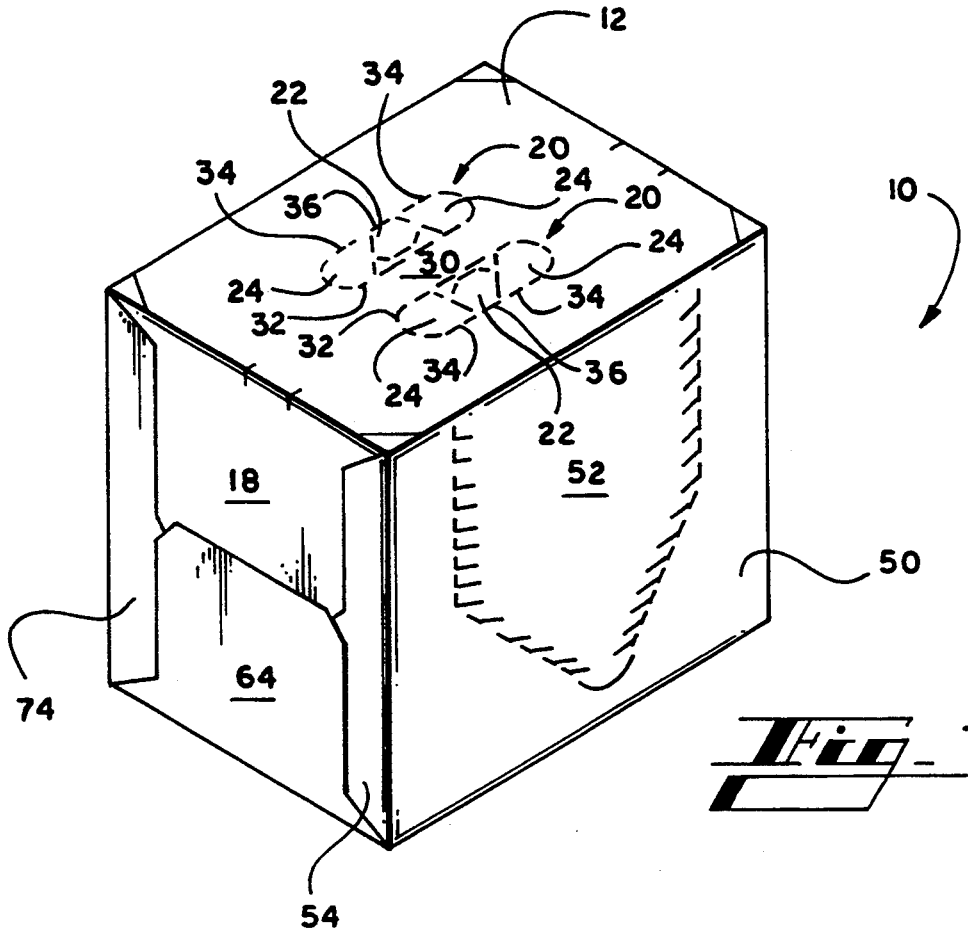
Fig. 1
Fig. 4
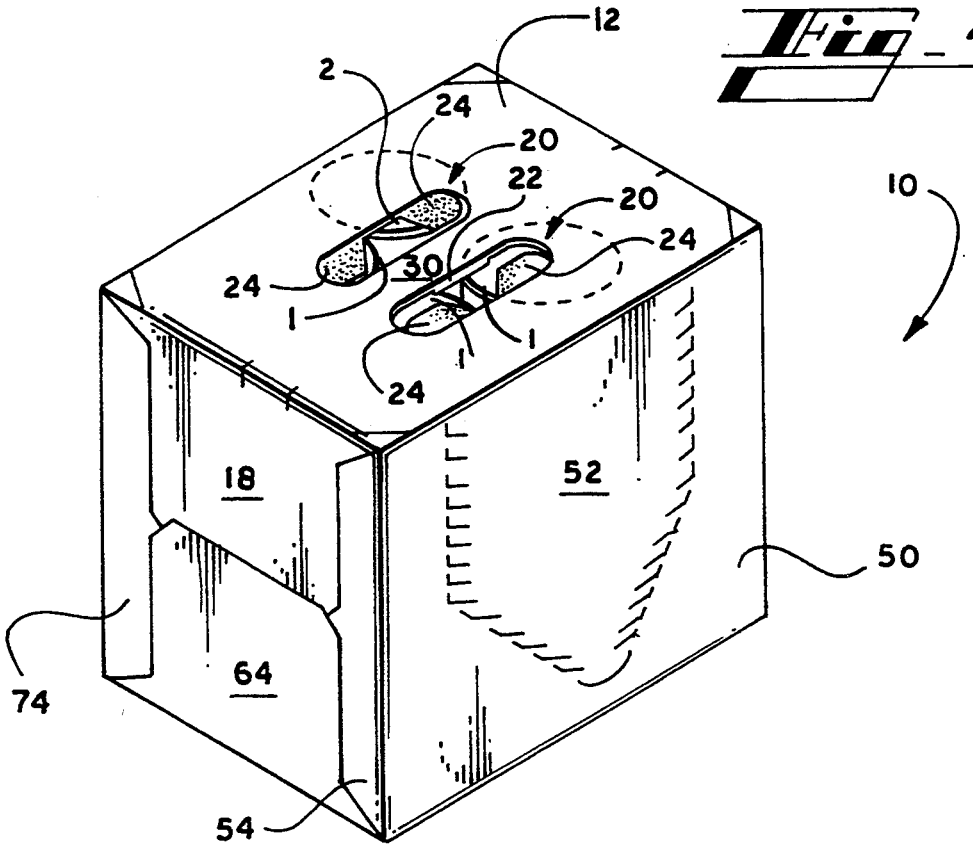

INTEGRAL HANDLE FOR CARTON FOR BEVERAGE CAN PACKAGE

BACKGROUND OF THE INVENTION

The invention relates generally to cartons for forming packages of articles such as beverage cans, and more particularly to such cartons having a handle integrally formed with the carton by means of spaced-apart openings in a panel of the carton.

In the merchandising of articles such as cans of beverage it is often desirable to package multiple articles in a single container for distribution and sale. A carton forming a container for such articles is often provided with a handle as a convenient means of transporting the package. The handle may be made convenient if it is integrally formed with the carton. Generally, to create an integrally-formed handle in a carton, particularly a handle that allows the hand of a user to easily grasp the handle member, an area of the carton adjacent the handle must be folded away and/or removed. However, when the area around the handle of a carton is folded away or removed, the opening into the carton thereby created allows dirt, debris and other undesirable elements to enter the package and settle upon the lids of encased cans or other articles.

What is needed, therefore, is a handle integrally formed with a carton in a manner that preserves the integrity of the carton and its contents.

SUMMARY OF THE INVENTION

The present invention provides a handle integrally formed with a carton by apertures adjacent the handle. Each aperture is covered by a combination of tabs which may be pivoted out of the plane of the aperture to define the sides of the handle. In a tripartite arrangement of tabs a center (or central) tab lies between opposing end tabs. The center tab is contoured and etched with fold lines in a manner which encourages bending of the center tab about cans or similar articles encased by the carton.

Other advantages and objects of the present invention will be apparent from the following description, the accompanying drawings, and the appended claims.

BRIEF DESCRIPTION OF THE DRAWINGS

FIG. 1 is a perspective view of a carton having a handle integrally formed with the carton according to a preferred embodiment of the invention.

FIG. 4 is a perspective illustration of the package of FIG. 1 with tabs folded away from apertures in the top panel of the carton to provide access to the handle.

DETAILED DESCRIPTION OF THE PREFERRED EMBODIMENT

Figure 2:
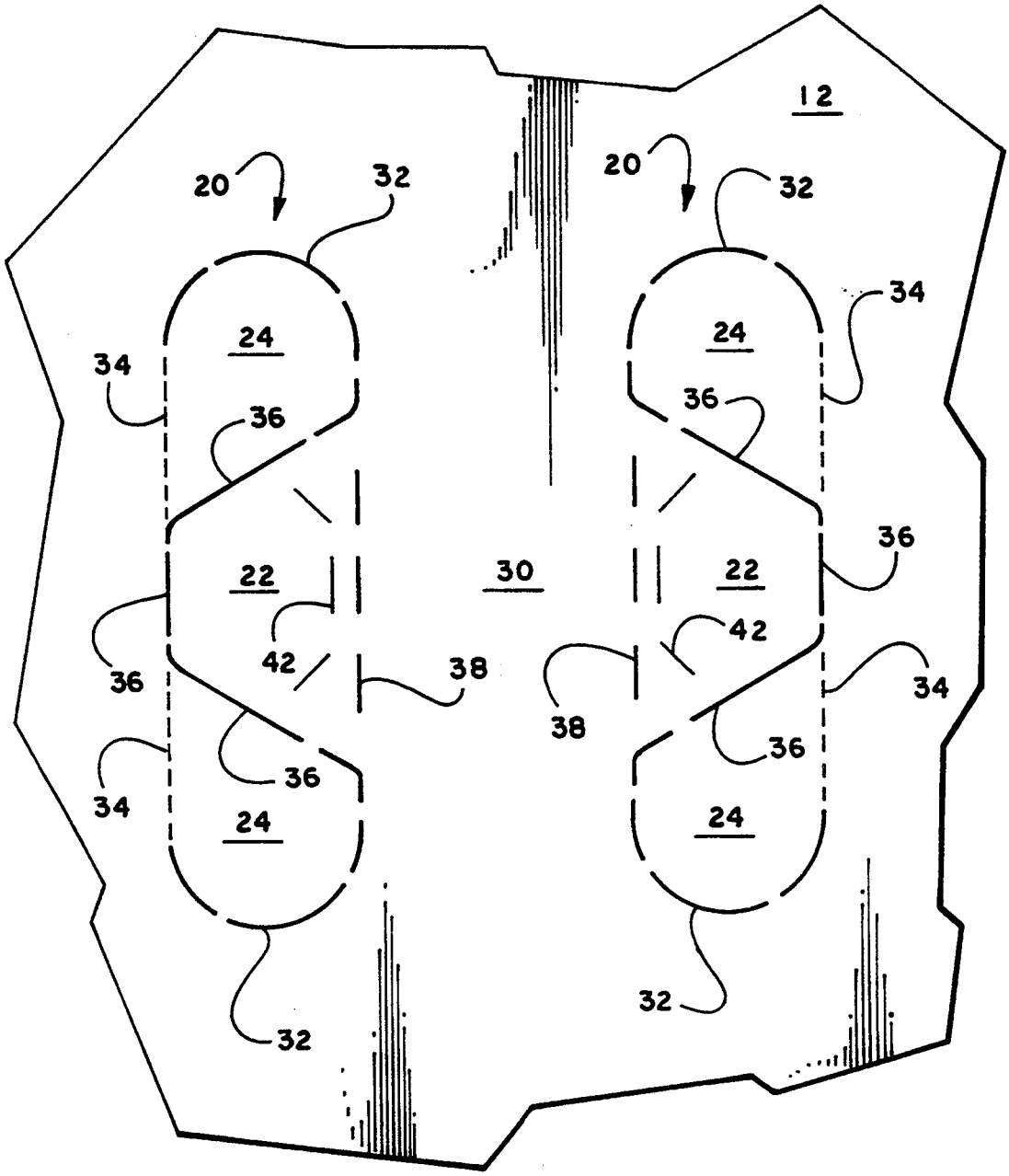
FIG. 2 is top plan view of a segment of the top panel of the carton of FIG. 1.

The present invention provides a handle integrally formed with a panel of a carton by apertures which define the sides of the handle. A combination of coordinating tabs fit within and completely cover each aperture. The tabs may be pushed away from the apertures to form the handle. The tabs are configured and aligned to provide quick, easy access to a band-like handle and to also provide reinforcement for the center portion of the handle. In the drawings and description which follow, although the handle is described in conjunction with a typical carton, it will be clearly understood that the handle of the invention may be used with cartons having configurations differing from the exact carton described herein. Throughout the drawings the same reference numerals refer to identical features.

Referring first to FIG. 1, therein is illustrated a package formed from a carton 10 having a handle integrally formed with a panel of the carton according to a preferred embodiment of the invention. A typical carton 10 used to illustrate the features of the invention is essentially a cubic or rectangular solid formed from panels. The integral handle of the preferred embodiment of the invention is formed in the top panel 12 of the carton 10. The integral handle is formed by apertures 20 spaced apart to create a band 30 in the top panel. For simplicity and convenience, the band 30 will sometimes hereinafter be referred to as the handle 30. The apertures 20 of the preferred embodiment illustrated are elongated so that a hand may be easily inserted to grasp the handle 30. Each aperture is covered by a combination of tabs 22, 24. The tabs 22, 24 are configured and attached to the top panel 12 in a manner that permits them to be pushed out of the apertures 20 and folded away to allow clear access to the handle 30. In general, each aperture is defined by cut lines 32, 36 and fold lines 34, 38 (fold line 38 is not denoted in FIG. 1 but is illustrated in subsequent figures). The tab 22, 24 features and the lines which define the apertures 20 and tabs 22, 24 will be discussed in greater detail below. In FIG. 1 the general features of the carton 10 which can be seen in addition to the top panel 12 are an end flap 18 connected to the top panel 12, a front panel 50, a front opening flap 52, side flaps 54, 74 connected to the respective front 50 and rear panels, and an end flap 64 connected to the bottom panel.

Figure 3:
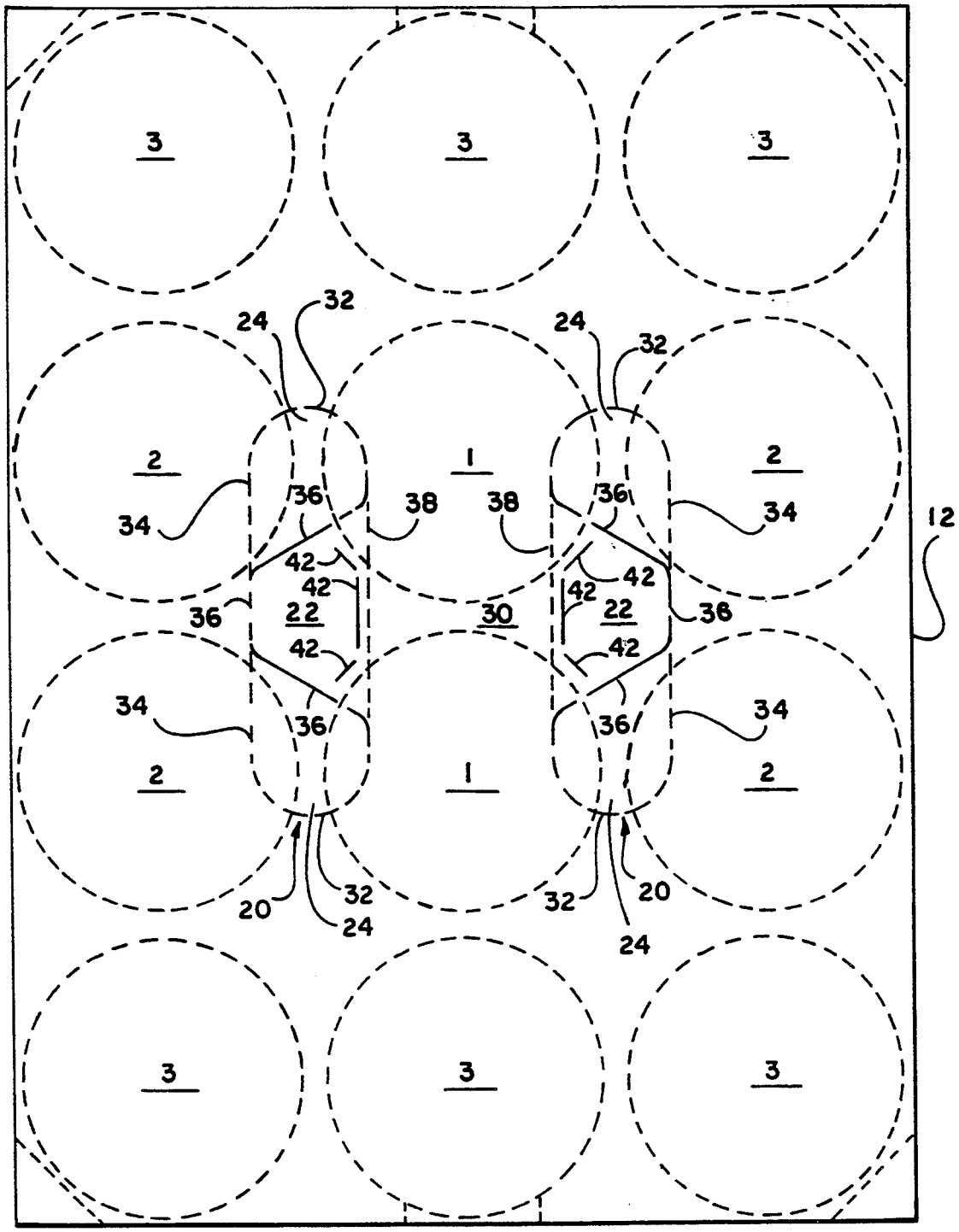
FIG. 3 is a top plan view of the top panel of the carton of FIG. 1, with cans adjacent the top panel shown in phantom illustration.

Referring now particularly to FIG. 2 and FIG. 3, FIG. 2 illustrates in plan view a portion of the top panel 12 containing the handle 30 while FIG. 3 is a top plan view of the carton 10 of FIG. 1 illustrating the entire top panel 12. In FIG. 3, cans 1, 2, 3 adjacent the top panel 12 are illustrated in phantom form to help explain the features of the invention. Although varied combinations of tabs may be used to cover the apertures 20 a three-tab combination is used to cover the elongated apertures 20 in the preferred embodiment. The three-tab combination consists of a center (or central) tab 22 positioned between opposing end tabs 24. As partially discussed above, the tabs 22, 24 are related to the apertures 20 by a series of cut and fold lines. The center tab 22 is hinged within each aperture 20 adjacent the handle 30. The end tabs 24 are hinged within each aperture 20 opposite the handle 30 side. A cut line 32 defines a portion of each end tab 24. Each end tab 24 is connected to the top panel 12 (within the aperture 20) in hinge-like fashion along a scored lined 34. A cut line 36 separates a tapered end of the center tab 22 from the aperture 20. The cut line 36 also extends along the tapered sides of the center tab 22 to separate the center tab 22 from the end tabs 24. The center tab 22 is joined in hinge-like fashion to the top panel 12 (within the aperture 20) by a perforated fold line 38. For convenience, the perforated fold line 38 connecting the center tab 22 to the top panel 12 will be referred to as the primary perforated fold line 38. A second perforated fold line 42 essentially parallel to the primary perforated fold line 38 and having a wide-mouthed, wide-based V shape will for convenience be referred to as a secondary perforated fold line 42. The apertures 20 formed are spaced apart creating a band-like handle 30 within the top panel 12. Referring now particularly to FIG. 3, the phantomly-illustrated cans 1, 2, 3 are numbered so that they may be identified by their position with respect to the apertures 20 and handle 30. For purposes of explanation and illustration, the cans may be considered to occupy three general positions, namely, cans 1 that are aligned directly under the handle 30, cans 2 that are aligned partially under the apertures and adjacent the cans 1 directly under the handle 30, and cans 3 that are not aligned under either the apertures 20 or handle 30. Referring now to FIGS. 2 and 3, the center tab 22 is aligned over a spacing formed between the set of cans 1, 2 which lie under the aperture 20. The center tab 22 tapers from its hinge line 38 toward the opposite side of the aperture 20, giving the center tab 22 a generally V-shaped configuration. The V shape of the center tab 22 and of the secondary perforated fold line 42 correspond to the essentially V-shaped spacing formed between adjacent cans 1 which lie directly under the handle 30. The V-shaped spacing formed between adjacent cans 1 is clearly illustrated in FIG. 3 by the phantom lines of the cans 1, 2, 3.

To utilize the handle 30, the center tab 22 is pushed through the top panel 12. As the center tab 22 is pushed downward, its tapered configuration allows it to fit within and be pushed past the spacing between the cans 1 directly beneath. The center tab 22 generally pivots about the primary perforated fold line 38. As the center tab 22 is pushed downward, it bends to conform to the V-shaped spacing between the cans. Maximum bending of the center tab 22 between the cans 1 is promoted by the secondary perforated fold line 42. The generally V-shaped secondary perforated fold line 42 is aligned over the rims of the cans 1 and the spacing between the cans 1. As shown, the legs of the V-like secondary perforated fold line 42 are positioned slightly over or just beyond the tops of the cans 1 and the wide base of the V-shaped fold line 42 is positioned over the V-shaped space between the cans 1. The positioning of the secondary perforated fold line 42 encourages bending about an axis defined by that fold line 42. Thus, when the center tab 22 is pushed downward the tab 22 tends to bend inwardly towards the spacing between cans 1. The center tab 22 may then be pushed inwardly completely out of the plane of the aperture 20 and top panel 12 and the handle 30 may be grasped. As the handle is grasped, the center tab 22 is generally folded under the handle 30. The end tabs 24 are pivotable about the respective scored lines 34. Either prior to or simultaneously with the grasping of the handle 30, the end tabs 24 are pushed away from their connection along the cut lines 34 and 31. The end tabs 24 may be left in place but detached from the top panel along the cut line 32 and pivoted out of the plane of the top panel 12 by an inserted hand. It is to be noted that fewer than or more than three tabs may be used, however, the invention works very well when at least one tab of an aperture 20 is centered over the spacing between cans 1 located below the aperture 20. The particular combination of three tabs 22, 24 works well because placement of the center tab 22 adjacent the handle 30 requires that only that one tab 22 be manipulated and moved out of the way to allow an individual's hand to fit under the handle 30. Also, each center tab 22 reinforces the center portion of the handle 30. This is important because the center portion of the handle 30 is subjected to stress resulting from the weight of the package when lifted. When the package is lifted its weight is concentrated at the lifting point of the handle 30. The end tabs 24 perform their covering function well but do not hinder access to the handle 30 because of their placement hinged to the side of the aperture 20 opposite the handle 30. It is also noted that although the invention is described in a preferred embodiment wherein a pair of covered apertures 20 form a band 30 between them the invention may also be applied in the context of a single covered aperture 20 to form the handle. Application of the invention in this context is also achieved if only one of the apertures 20 illustrated is utilized.

Referring now to FIG. 4, therein is shown the carton 10 and package of FIG. 1 after full displacement of the center tabs 22 and partial displacement of the end tabs 24 from the apertures 20 to provide full access to the handle 30. The alignment and spacing between adjacent ones of the central cans 1 referred to above is partially visible through the openings of the apertures 20. One of the cans 2 adjacent the centrally-located cans 1 can also be seen through the opening in the aperture 20 exposed by removal of the center (central) tabs 22. One of the center tabs 22 which has been folded under the band 30 is also shown in this view.

Figure 5:
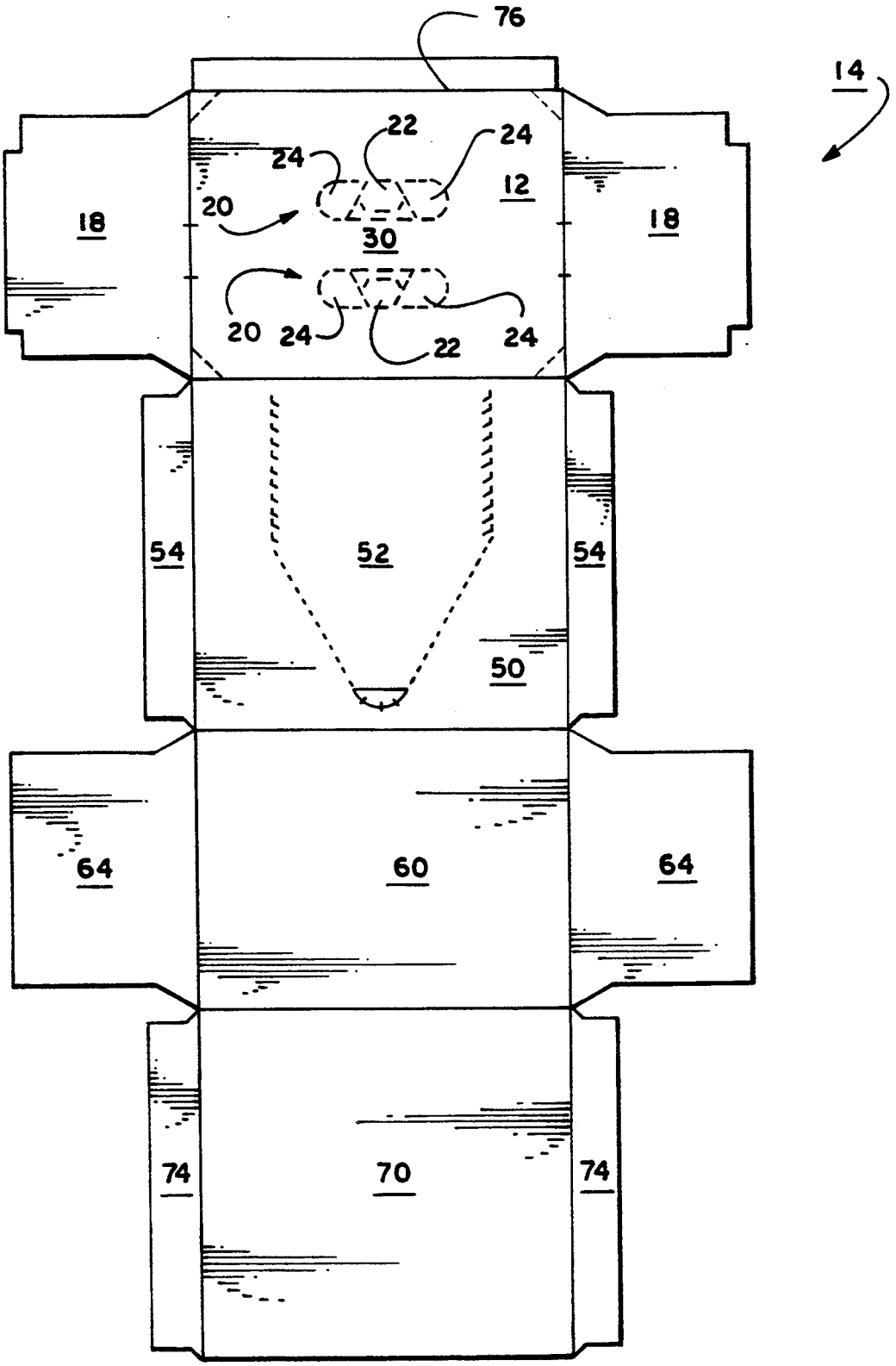
FIG. 5 is a plan view of a blank for forming the carton shown of FIG. 1.

FIG. 5 is a plan view of a blank 14 for forming a typical carton 10 having the integral handle described above. This illustration helps show the alignment of the key elements of the handle as discussed above in relation to the elements of a typical carton blank. As previously discussed, the integral handle 30 is formed in a top panel 12 between a pair of apertures 20 which are covered by a combination of center 22 and end 24 tabs. The top panel has end flaps 18. A front panel 50 is flanked by end flaps 54 and has a front opening panel 52. The bottom panel 60 has side panels 64 and the rear panel 70 has side panels 74. The flap 76 attached to the top panel 12 facilitates closure of the blank into a typical carton 10 which contains a handle 30 according to a preferred embodiment of the invention. As in a typical carton 10 formed from a blank of this nature, the main panels 12, 50, 60, 70 provide the essential tubular structure of the carton and the various end flaps 18, 54, 64, 74 provide the means for enclosing the ends of the carton 10.

Other modifications may be made in the foregoing without departing from the scope and spirit of the claimed invention. For example, the elongated configuration of the apertures 20 of the preferred embodiment permits an individual's hand to be easily inserted through the apertures 20 to grasp the elongated, band-like handle 30. However, apertures having other configurations may also be used. An aperture not necessarily elongated but which provides access to the thumb and a finger of an individual sufficient to allow the portion of the panel top between the thumb and finger to be grasped is also suitable. Other variations of the invention include the location and spacing of tabs which cover the apertures. Each aperture 20 could be covered by a single tab rather than the combination shown. For example, a single central tab may be used. Another variation is that the central tab 22 of the three-tab combination may be attached to the opposite side of the aperture 20 so that the center tab 22 folds along a line of the aperture 20 which is opposite the handle 30. However, although this alternate arrangement is suitable to utilize the handle of the invention, the arrangement of the center tab 22 and end tabs 24 as described above allows the center tabs 22 to be folded under the handle 30 in one motion as the handle 30 is grasped. And, as previously described, when the center tabs 22 are folded under the handle 30 the handle 30 is thereby reinforced. Still another variation of the tab arrangement is to have all of the tabs attached to a common side of the aperture 20. However, the opposing arrangement of the center tab 22 and the end tabs 24 facilitates easy insertion of the hand of an individual. In the three-tab, opposing-side arrangement of the preferred embodiment as a hand is inserted, the thumb and at least one finger of the hand push through each center tab 22 separating it from the end tabs 24 and the side of the aperture 22 opposite the handle 30. As the hand is inserted further and the handle 30 is grasped, the handle 30 portion is lifted, the center tabs 22 are folder under the handle 30 and the end tabs 24 become separated from the unhinged, non-folding portions 32 of the aperture 20. As a hand is inserted, the end tabs 24 that are on the side of the handle 30 that is engaged by the fingers and the end tab 24 that is on the side of the handle 30 that is generally engaged by the knuckle or Other back portion of the thumb are conveniently pushed downwardly out of the plane of the top panel 12, thereby allowing free access to the handle 30. Although the end tabs 24 do not have to be hinged 34 to the top panel 12 a hinged connection 34 assures that the end tabs 24 will be held in position until pushed out of the plane of the aperture 20. The hinged connections 34, 38 (rather than simply tear-away connections) of the respective end tabs 24 and center tabs 22 keeps those tabs 24, 22 attached to the carton until the entire carton is disposed of, thereby maintaining carton integrity and reducing litter and additional throw-away material. However, in the invention the scored fold lines 34, 38 may also be perforated fold lines which not only allow pivoting of the respective tabs 22, 24 but which also permit the tabs 22, 24 to be torn away when desired and properly disposed of. It is also noted that the handle of the invention will perform well with articles other than cylindrical articles. It is only necessary that the articles permit a hand to be inserted through the apertures 20. For example, the handle 30 is suitable for use with cartons containing individual-serving-size milk cartons which have gable-shaped tops. Such cartons have spacings between the gable-shaped tops which will permit a hand to be inserted, which will permit tabs to be pushed and folded back out of the plane of the apertures and which will permit the handle 30 to be grasped.

What is claimed is:

1. A handle for a carton for at least one array of articles defining spaces between adjacent ones of the articles, the carton having a top panel comprising:

at least one elongated aperture defined in said top panel;

a pair of opposing end tabs generally filling a respective end of said at least one elongated aperture hingedly connected to a first side thereof; and a central tab member generally filling a central portion of said elongated aperture between said respective ends thereof hingedly connected to a second side thereof opposite said first side thereof, said central tab member having a configuration suitable for allowing said central tab member to be pushed through the spaces between adjacent ones of the articles past the articles and folded under the top panel.

2. The handle of claim 1, wherein the articles in the at least one array of articles of the carton are cylindrical articles and the spaces defined between adjacent ones of the articles are generally V-shaped spaces, wherein said central tab member has a generally V-shaped configuration and wherein said central tab member has means for promoting bending thereof in conformity with one of the generally V-shaped spaces.

3. The handle of claim 2, wherein said means for promoting bending of said central tab member in conformity with one of the generally V-shaped spaces comprises a generally V-shaped fold line inscribed upon said central tab member proximate said second side of said at least one elongated aperture.

4. The handle of claim 1, wherein said at least one elongated aperture defined in said top panel comprises a pair of spaced apart elongated apertures defining an integral member between said second sides of said elongated apertures.

5. The handle of claim 4, wherein the articles in the at least one array of articles of the carton are cylindrical articles and the spaces defined between adjacent ones of the articles are generally V-shaped spaces, wherein said central tab member has a generally V-shaped configuration and wherein said central tab member has means for promoting bending thereof in conformity with one of the generally V-shaped spaces.

6. The handle of claim 5, wherein said means for promoting bending of said central tab member in conformity with one of the generally V-shaped spaces comprises a generally V-shaped fold line inscribed upon said central tab member proximate said second side of said at least one elongated aperture.

7. A handle for a carton for at least one array of cylindrical articles defining generally V-shaped spaces between adjacent ones of the cylindrical articles the at least one array of cylindrical articles having ones of the cylindrical articles centrally positioned therein, the carton having a top panel comprising:

a pair of spaced apart elongated apertures defining an integral elongated member in the top panel;

a pair of end tabs respectively generally extending throughout each end of each said elongated aperture transversely of and foldably joined to a first side thereof opposite said integral elongated member; and a center tab mediate and adjacent said end tabs taperingly extending transversely of and foldably joined to a second side of each said elongated aperture adjacent said integral elongated member; and wherein said elongated apertures are positioned upon the top panel such that said integral elongated member is aligned over the ones of the cylindrical articles which are centrally positioned in the array, and such that each respective said center tab is aligned over one of the generally V-shaped spaces defined between adjacent ones of the cylindrical articles centrally located in the array.

8. The handle of claim 7, each said center tab having means for promoting bending thereof in conformity with the one of the generally V-shaped spaces defined between adjacent ones of the cylindrical articles centrally located in the array.

9. The handle of claim 8, said means for promoting bending of each said center tab in conformity with the one of the generally V-shaped spaces defined between adjacent ones of the cylindrical articles centrally located in the array comprising a generally V-shaped fold line inscribed upon said center tab proximate said integral elongated member.

10. The handle of claim 7, wherein edges of said end tabs and each respective said center tab not foldably joined to each respective said elongated aperture are releasably connected to a perimeter thereof and wherein each respective said center tab and said end tabs are releasably connected to one another.

11. A blank for a carton for at least one array of cylindrical articles defining generally V-shaped spaces between adjacent ones of the cylindrical articles comprising:

a top panel defining a pair of elongated apertures spaced apart to define an integral handle member, each said elongated aperture having a pair of end tabs respectively extending over each end thereof transversely of and foldably joined to a first side thereof opposite said integral handle member and having at least one center tab mediate and adjacent said end tabs taperingly extending transversely of and foldably joined to a second side thereof adjacent said integral handle member, wherein said elongated apertures are positioned upon the top panel such that said integral elongated member is aligned over ones of the cylindrical articles which are centrally located in the array and such that said at least one center tab is aligned over one of the V-shaped spaces defined between adjacent ones of the cylindrical articles centrally located in the array;

a plurality of panel members at least one thereof foldably joined to said top panel and the remainder thereof foldably joined to another of said plurality of panel members or to said top panel so that a tubular structure may be formed therefrom together with said top panel; and closure means for securing ends of said tubular structure.

12. The blank of claim 11, each said at least one center tab having means for promoting bending thereof in conformity with an underlying V-shaped space.

13. The blank of claim 12, said means for promoting bending of each said at least one center tab in conformity with an underlying V-shaped space comprising a generally V-shaped fold line inscribed thereupon proximate said integral elongated member.

14. The blank of claim 11, wherein edges of said end tabs and each respective said at least one center tab not foldably joined to a respective said elongated aperture are releasably connected to a perimeter thereof and wherein each respective said at least one center tab and said end tabs are releasably connected to one another.

15. A package comprising:

at least one array of articles defining spaces between adjacent ones thereof;

a carton disposed around an exterior of said at least one array of articles, said carton having a top panel adjacent a topmost array of said at least one array of articles, said top panel having at least one elongated aperture defined in said top panel;

a pair of opposing end tabs generally filling a respective end of said at least one elongated aperture, said pair of opposing end tabs hingedly connected to a first side of a respective said elongated aperture; and a central tab member generally filling a central portion of said at least one elongated aperture between said ends thereof hingedly connected to a second side thereof opposite said first side thereof having a configuration suitable for allowing said central tab member to be pushed through the spaces between adjacent ones of the articles past the articles and folded under the top panel.

16. The package of claim 15, wherein said articles are cylindrical articles and the spaces between adjacent ones of the articles are generally V-shaped spaces, wherein said central tab member has a generally V-shaped configuration and wherein said central tab member has means for promoting bending thereof in conformity with an underlying one of the generally V-shaped spaces.

17. The package of claim 16, wherein said means for promoting bending of said central tab member in conformity with an underlying one of the generally V-shaped spaces comprises a generally V-shaped fold line inscribed upon said central tab member proximate said second side of a respective said elongated aperture.

18. The package of claim 15, wherein said at least one elongated aperture defined in said top panel comprises a pair of spaced apart elongated apertures defining an integral member therebetween.

19. The package of claim 18, wherein said articles are cylindrical articles and the spaces between adjacent ones of the articles are generally V-shaped spaces, wherein said central tab member has a generally V-shaped configuration and wherein said central tab member has means for promoting bending thereof in conformity with an underlying one of the generally V-shaped spaces.

20. The package of claim 19, wherein said means for promoting bending of said central tab member in conformity with an underlying one of the generally V-shaped spaces comprises a generally V-shaped fold line inscribed upon said central tab member proximate said second side of a respective said elongated aperture.

* * * * *